United States Patent [19]

Gratzinger et al.

[11] 4,427,966

[45] Jan. 24, 1984

[54] PIVOTING ROTOR RATCHET MECHANISM FOR WORM GEAR POTENTIOMETER

[75] Inventors: Paul G. Gratzinger, Moreno; Lawrence Kucharski, Jr., Sunnymead, both of Calif.

[73] Assignee: Bourns, Inc., Riverside, Calif.

[21] Appl. No.: 442,703

[22] Filed: Nov. 18, 1982

[51] Int. Cl.[3] ..... H01C 10/32

[52] U.S. Cl. ..... 338/162; 338/174; 338/184; 338/199; 338/DIG. 1

[58] Field of Search ..... 338/162, 163, 174, DIG. 1, 338/164, 184, 188, 199

[56] References Cited

U.S. PATENT DOCUMENTS

| | | | |
|---|---|---|---|
| 3,416,119 | 12/1968 | Van Benthuysen et al. | 338/174 |
| 3,446,085 | 5/1969 | Ginsberg | 338/DIG. 1 X |
| 3,596,223 | 7/1971 | Stuckey et al. | 338/174 |
| 4,357,561 | 11/1982 | Gray | 338/DIG. 1 X |

*Primary Examiner*—C. L. Albritton

*Attorney, Agent, or Firm*—Howard J. Klein; William G. Becker

[57] ABSTRACT

A ratcheting mechanism for a multiturn variable resistance device, of the worm screw-actuated type, has mutually engageable stopping members on the rotor and in the housing, limiting rotor travel beyond first and second limits. The stopping member in the housing has an inclined surface on one side which pivotally lifts the rotor against the force of the electrical contact spring (carried on one side of the rotor in contact with a resistive element), when the rotor reaches the first limit of travel. The pivoting action compresses the contact spring while allowing the spur gears on the rotor momentarily to disengage from the worm gear. This disengagement releases the spring, which then urges the rotor back into a gear-engaging position. The rotor is provided with at least one axially-shortened spur gear tooth positioned so as to be engageable with the worm gear when the rotor is at the second limit of travel. The further rotation of the rotor beyond the second limit of travel being inhibited by the engagement of the stopping member, the engagement of the shortened tooth with the worm gear pivotally lifts the rotor, thereby compressing the spring and momentarily disengaging the spur and worm gears. Following the momentary disengagement, the spring is released, thereby urging the rotor back into a gear-engaging position.

20 Claims, 9 Drawing Figures

56
56
56
50
48
52
54
54
54
46
30
42
44
40
40
34
10
32
36
38
12
24
28
26
14
22
18
20
16

PIVOTING ROTOR RATCHET MECHANISM FOR WORM GEAR POTENTIOMETER

BACKGROUND OF THE INVENTION

This invention relates generally to the field of variable resistors. More particularly, the invention relates to a ratcheting mechanism for variable resistors of the type actuated by a worm screw engaging a spur gear.

Variable resistors or potentiometers of the worm screw-actuated type are well-known in the art, as exemplified in U.S. Pat. Nos. 3,179,910 - Grunwald; 4,004,264 - Hogue, et al; and 4,114,132 - DeRouen et al (the last named patent being commonly assigned with this application). Typically, in such potentiometers, the worm screw actuator must be rotated through several complete revolutions to cause the rotor-mounted contact or wiper to travel the length of the resistive element, the latter traversing a generally arcuate path of less than 360 degrees. To prevent discontinuities in resistance, end stops or other means are provided to prevent the wiper from leaving either end of the resistive element.

It has been found that a clutch or ratchet mechanism is necessary to prevent damage to the gears from continued rotation of the worm gear after an end stop has been reached.

A variety of types of such clutch or ratcheting mechanisms has been devised, some of which are exemplified in the aforementioned prior art patents. The approaches taken by the prior art have sought to provide a ratcheting mechanism capable of high reliability, in the sense of allowing gear slippage only at the end stops and positive gear re-engagement when the direction of screw rotation is reversed. A further objective is to provide such a function with a mechanism of compact size, as the further miniaturization of such potentiometers progresses. Related to both of these objectives is the goal of simplifying the structure as much as possible.

Another consideration in the design of such devices is the need to provide some audible indication that the device is ratcheting. Since these miniature potentiometers are sealed units, the mechanism is not visible to the operator, who must, therefore, have some other indication that an end stop has been reached. Thus, another design goal has been to provide an audible "click" when the ratcheting mechanism is in operation.

The prior art devices have satisfied one or more of the aforementioned goals with varying degrees of success. For example, the device disclosed and claimed in the above-mentioned patent to DeRouen et al has achieved reliability with a structure that is both relatively simple and compact, and which also yields a good audible "click" in the ratchet mode.

However, the DeRouen et al. device uses an over-center spring both for the wiper contact and for engaging the ratchet mechanism with the worm screw at the limits of rotor travel. While this arrangement is entirely acceptable in many applications, in other applications it is more desirable to use an off-center spring. While reasons for such desirability vary, spring shape, size, and configuration are often constrained by the spring's primary purpose as an electrical contact, with its ratchet-engagement function being subservient to this purpose. Thus, in many instances, an off-center spring is the optimal design from the standpoint of electrical function, while in other instances, packaging constraints may dictate the use of an off-center spring.

Thus, it would be of benefit to the industry to provide a potentiometer ratcheting mechanism which is both reliable and adapted for miniaturization, while also having the virtues of simplicity of structure and economy of manufacture. In addition, it would be advantageous to provide such a mechanism which is adapted for utilizing an off-center spring in the dual role of electrical contact element and ratchet mechanism engagement member.

SUMMARY OF THE INVENTION

Broadly, the present invention is a ratcheting mechanism for a worm screw-actuated variable resistor or potentiometer in which the ratcheting function is accomplished by tipping or pivoting the rotor at its two extremes of travel while disengaging the spur teeth of the rotor from the worm screw threads. The rotor is pivoted against the force of the contact spring, which then urges the spur teeth back into engagement with the worm screw threads. Thus, continued rotation of the worm screw in the direction in which the limit of rotor rotation has been reached causes ratcheting by repeated disengagement and re-engagement between the spur teeth and the screw threads, while positive engagement between the teeth and threads is provided when the direction of screw rotation is reversed.

Ratcheting is provided at one extreme of travel by pivoting the rotor upwardly from the edge adjacent the screw, while at the other extreme of travel, the rotor is pivoted upwardly from the edge opposite the screw. In this manner, clearance is necessary only on one side of the rotor, thereby minimizing space requirements.

This ratcheting function is accomplished with a rotor having an off-center contact spring on one face thereof and a plurality of spur gear teeth extending outwardly from its peripheral edge around less than 360 degrees of its circumference. The face of the rotor opposite that carrying the spring is provided with an annular recess interrupted by a stop member. A housing stop member is provided on the floor of the housing at a position approximately 180 degrees from the center of the intersection of the screw with the rotor. The housing stop is radially positioned so that when the rotor is in place, the housing stop fits into the annular recess. One radial face of the housing stop is inclined, forming a ramp. When the rotor is at one extreme of travel, the rotor stop is forced, by continued rotation of the screw, up the ramp against the force of the spring, until the last spur gear tooth momentarily disengages from the worm screw thread. The force of the spring then urges the rotor stop back down the ramp, re-engaging the tooth and thread. This action continues until the direction of screw rotation is reversed.

Although the other radial face of the housing stop can be inclined to provide a similar ratcheting action at the other extreme of rotor travel, it has been found preferable (for reasons which will be presented in the detailed description which follows) to use an alternative arrangement at the opposite extreme of travel. In this arrangement, the other radial face of the housing stop is made vertical, to act as a positive stop when the rotor stop abuts against it. The last one or two teeth of the rotor, which engage the screw at this extreme of rotor travel, are axially shortened so that they extend only partway down the peripheral edge from the top face thereof.

When the rotor stop abuts against the housing stop at this latter extreme of travel, the screw threads are in engagement with a shortened tooth. Further rotation of the screw causes a lifting action against the shortened tooth, thereby urging the adjacent edge of the rotor upward and compressing the spring. As the screw is further rotated, the thread moves past the shortened tooth, and the force of the spring causes the rotor to drop down into its prelifted position. This action continues until the direction of screw rotation is reversed, when the shortened tooth positively re-engages the thread, as would one of the normal spur gear teeth, to effect rotation of the rotor in the opposite direction.

As will be better appreciated from the detailed description which follows, the present invention provides reliable ratcheting using a mechanism which is simply constructed with a minimum of separate parts. By virtue of the simple construction, as well as through the use of a pivoting action requiring clearance on one side of the rotor only, space requirements are minimized, allowing high degrees of miniaturization. Moreover, the pivoting action makes advantageous use of the off-center spring arrangement, so that, like the previously-described DeRouen et al. device, the contact spring can serve double duty as part of the ratchet mechanism. Still further, it has been found that the ratcheting mechanism of the present invention provides an easily audible "click" at both extremes of travel.

DETAILED DESCRIPTION OF THE PREFERRED EMBODIMENT

Figure 1:
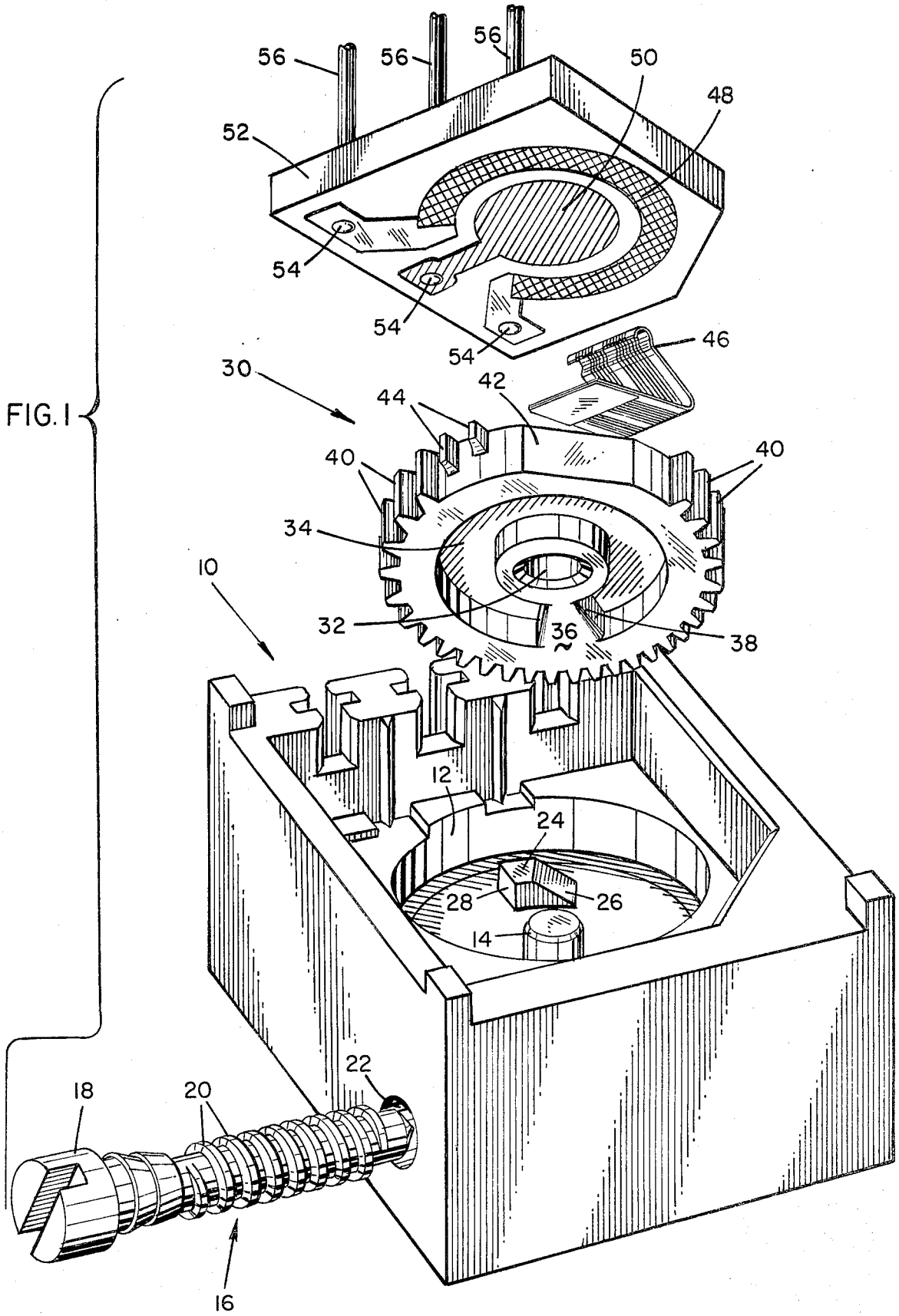
FIG. 1 is an exploded perspective view of a worm screw-actuated potentiometer incorporating the preferred embodiment of the present invention.

Referring to FIG. 1, the major components of a worm screw-actuated potentiometer in accordance with the present invention are shown.

The potentiometer comprises a housing 10, the interior of which has a generally circular recess or cavity 12. Centrally located in the cavity 12 is a generally cylindrical vertical post 14.

A worm screw 16 has a slotted head 18 (to accommodate a turning tool, such as a screwdriver) and an elongate worm gear portion 20 having a continuous thread, as shown. The worm gear 20 is accommodated in an elongate cavity 22 in the housing 10, offset to one side.

Located within the circular recess 12 is a fixed stop element or "housing stop" 24, having two radially-extending sides 26 and 28. One radial side 26 is sloped to form an inclined ramp. The opposite radial side 28 is substantially vertical.

A rotor 30, generally discoid in shape, is dimensioned to fit in the recess 12 and to be rotated therein. To this end, the underside of the rotor 30 has a central recess 32 forming a seat for the central post 14. The underside of the rotor 30 is also provided with a substantially annular recessed track 34, interrupted by a radially-extending stop 36, hereinafter referred to as the "rotor stop". The track 34 is dimensioned so as to accommodate the housing stop 24, as shown in FIGS. 2 through 9. The rotor stop 36 has a pair of radially extending walls 38 which are substantially vertical.

From the peripheral edge of the rotor 30 extends a plurality of evenly-spaced spur gear teeth 40. The teeth 40 extend radially, outward from somewhat less than the entire 360 degrees of the peripheral edge of the rotor, leaving a toothless gap 42 on the rotor edge. As best shown in FIG. 1, at least one, and preferably two, of the teeth 40 immediately to one side of the gap 42 are axially shortened so as to extend only partway down the peripheral edge of the rotor. For reasons which will be made clear below, these shortened teeth (designated by the numeral 44) should be on the side of the gap 42 closest to the vertical side 28 of the housing stop 24 when the rotor is installed in the recess 12. The remaining teeth 40, other than the shortened teeth 44, extend substantially all the way across the peripheral edge of the rotor.

Carried on the upper surface of the rotor 30 is a resilient contact spring or wiper spring 46. The wiper spring is located off-center (as best shown in FIGS. 2, 4, 6 and 8), and it provides electrical contact between a resistive element 48 and an adjacent conductive tap element 50. The resistive element 48 and the tap element 50 are formed, by various well-known techniques, on a substrate 52, which also carries conductive termination elements 54 as necessary to provide a potentiometric function.

The substrate 52 is installed in the housing 10 so that the wiper spring 46 is in compressed contact with the tap 50 and resistive element 48. The housing is finally sealed with a cover element (not shown). Each termination element 54 is conductively connected to a lead 56 which would extend through the cover element.

As with typical potentiometers of the worm screw-actuated type, the rotor 30 is rotated in both the clockwise and counterclockwise directions by rotation of the worm screw 16, through the engagement between the worm gear 20 and the spur gear teeth 40. When the rotor is thus rotated, the wiper spring 46 travels along the resistive element 48 while also maintaining contact with the tap element 50. Typically, several complete rotations of the worm screw 16 are needed for the complete traversal of the resistive element 48 from end-to-end by the wiper spring 46.

When the spring 46 has reached either end of the resistive element 48, it is necessary to stop further rotation of the rotor 30 by inadvertent rotation of the screw 16. However, it is also necessary that any such further rotation of the screw 16 not result in any damage to the mechanism, and it is further necessary to assure that when the direction of screw rotation is reversed, positive engagement between the worm gear 20 and spur gears 40 is accomplished. It is to these ends that the ratcheting mechanism of the present invention is directed.

The operation of the present invention is illustrated in FIGS. 2 through 9.

Figure 2:
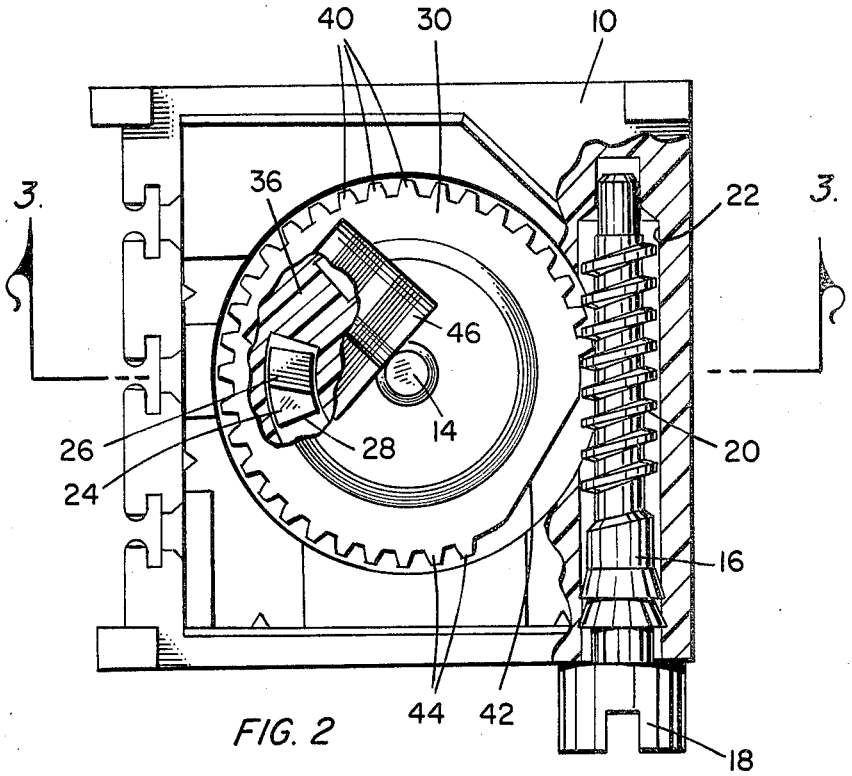
FIG. 2 is a top plan view, partially in section, of the potentiometer of FIG. 1, with the cover element removed, showing the rotor just prior to reaching its counterclockwise limit of travel.
Figure 3:
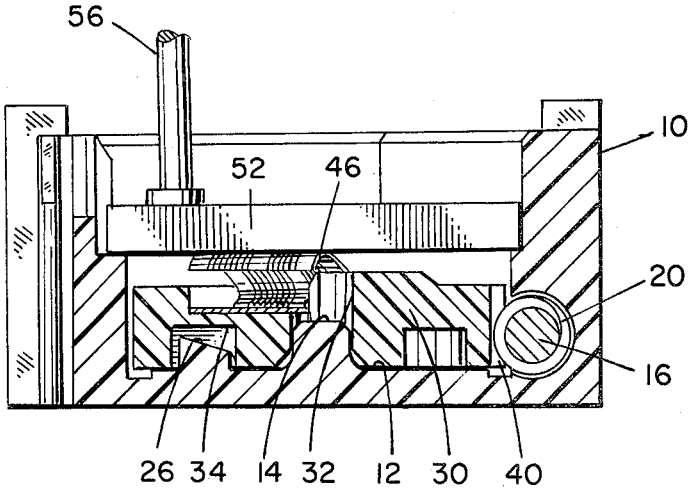
FIG. 3 is a cross-sectional view taken along line 3—3 of FIG. 2.

In FIGS. 2 and 3, the rotor 30 is shown just before it has reached its counterclockwise (as viewed from the top) limit of travel. The rotor stop 36 is approaching, but has not yet reached, the ramp side 26 of the housing stop 24. The worm gear 20 is still in engagement with one or more spur gear teeth 40. As shown in FIG. 3, the rotor 30 is substantially level, flush against the bottom of the circular recess 12, with a clearance space between the rotor 30 and the substrate 52.

Figure 4:
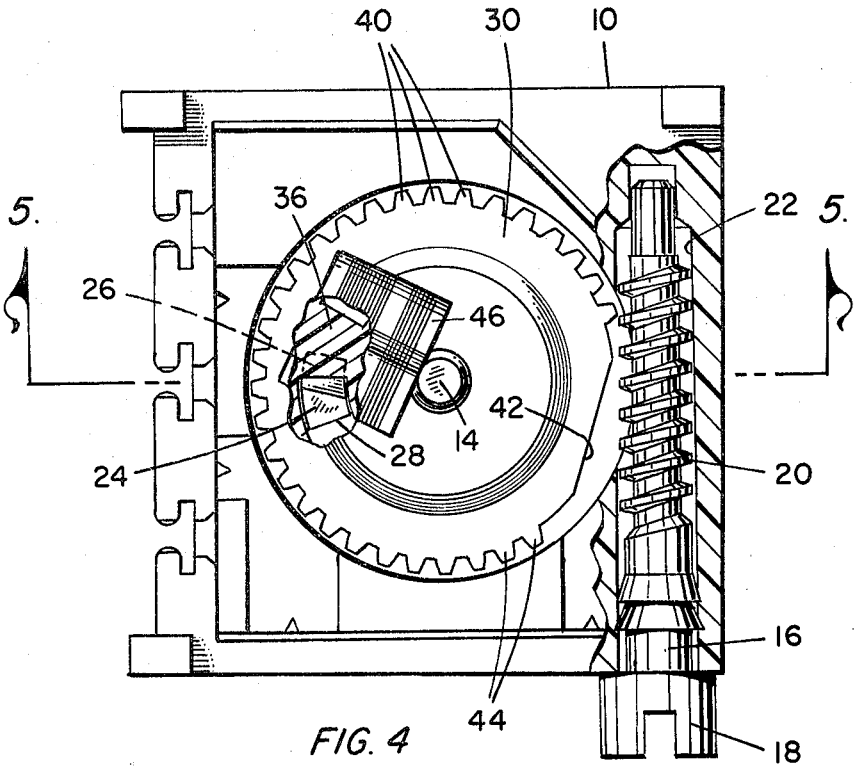
FIG. 4 is a view like that of FIG. 2, showing the rotor in its ratcheting position at its counterclockwise limit of travel.
Figure 5:
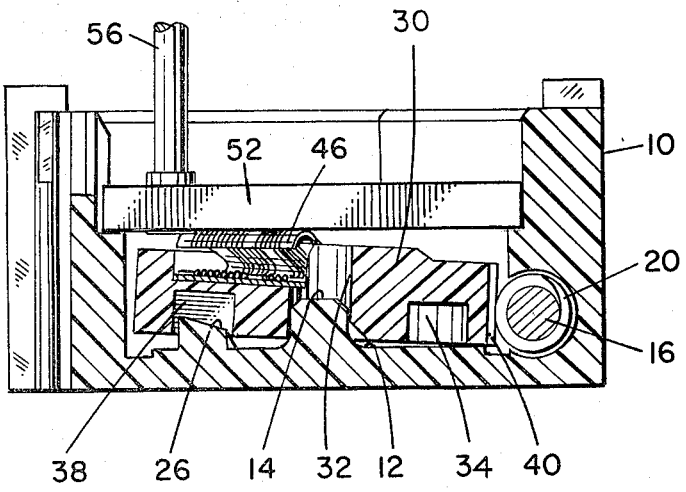
FIG. 5 is a cross-sectional view along line 5—5 of FIG. 4.

FIGS. 4 and 5 illustrate the ratcheting action that is achieved when the rotor 30 has reached its counterclockwise limit of travel. When this has happened, continued rotation of the screw 16 in the counterclockwise direction forces the rotor stop 36 up the ramp side 26 of the housing stop 24, thus causing the rotor 30 to pivot upwardly from the edge adjacent the screw 16, as best shown in FIG. 5. As also shown in FIG. 5, this pivoting action further compresses the wiper spring 46. Thus, when continued counterclockwise rotation of the screw momentarily causes disengagement between the worm gear 20 and the last of the spur gear teeth 40 before the gap 42, the force of the spring 46 urges the rotor stop 36 down the ramp 26, causing a slight clockwise rotation of the rotor 30, bringing the worm and spur gears back into engagement. The rotor is thus in position either for another ratcheting movement, or for immediate clockwise rotation when the direction of screw rotation is reversed.

Ratcheting at the clockwise limit of rotor travel could easily be provided in the same manner. All that would be needed is to provide a ramp on both radially-extending sides of the housing stop 24, rather than just on one, as illustrated. However, it has been found that with the configuration shown, the ratcheting sound or "click" is less audible at the clockwise limit of rotor travel than at the counterclockwise limit when ratcheting is provided at both limits by a ramped housing stop. This phenomenon results from the fact that during counterclockwise rotation, the worm gear 20 tends to press downwardly on the adjacent edge of the rotor 30, thereby providing an enhanced pivoting action which results in increased compression of the spring 46. This ultimately results in a more forceful action of the spring 46 against the rotor 30 when the worm gear 20 disengages the spur gear teeth 40, thereby creating a louder sound when the rotor 30 is forced down the housing stop ramp 26 and the spur gear teeth 40 strike the worm gear 20.

During clockwise rotation, however, the worm gear 20 tends to lift the adjacent edge of the rotor 30. This lifting action would lessen the compression of the spring 46 when the rotor is pivoted by the engagement between the rotor stop 36 and the ramp. The result would be a decreased force of spring reaction on the rotor 30 when the gears disengage, so that the rotor 30 would strike the worm gear less forcefully, producing a less audible sound.

Therefore, in order to provide a suitably loud "click" at the clockwise limit of travel, the mechanism shown in FIGS. 6 thru 9 is used.

Figure 6:
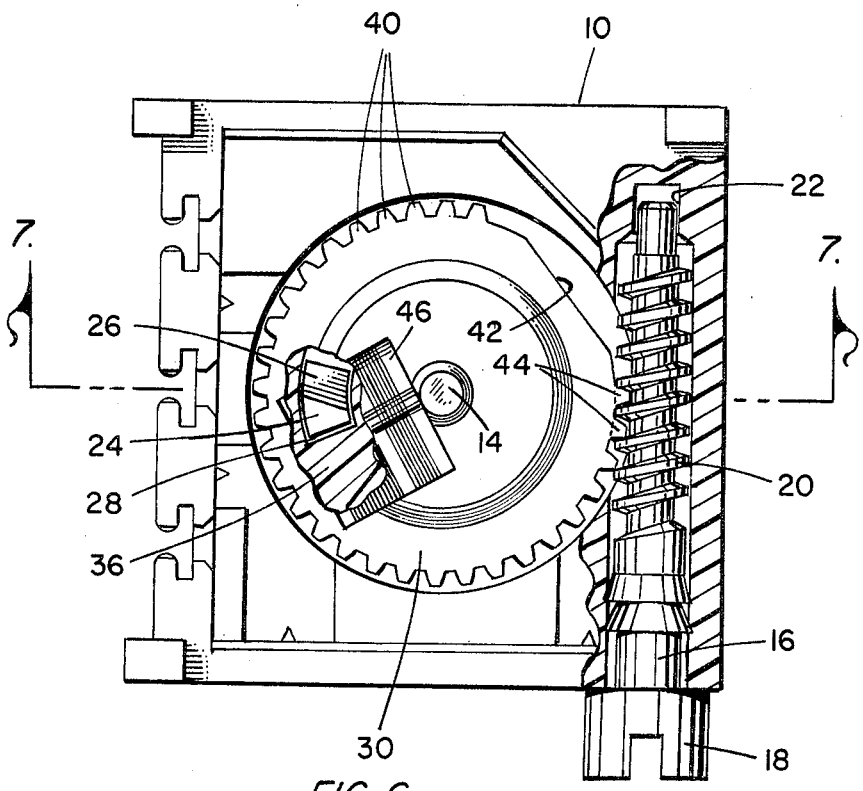
FIG. 6 is a view like that of FIG. 2, showing the rotor just prior to reaching its clockwise limit of travel.
Figure 7:
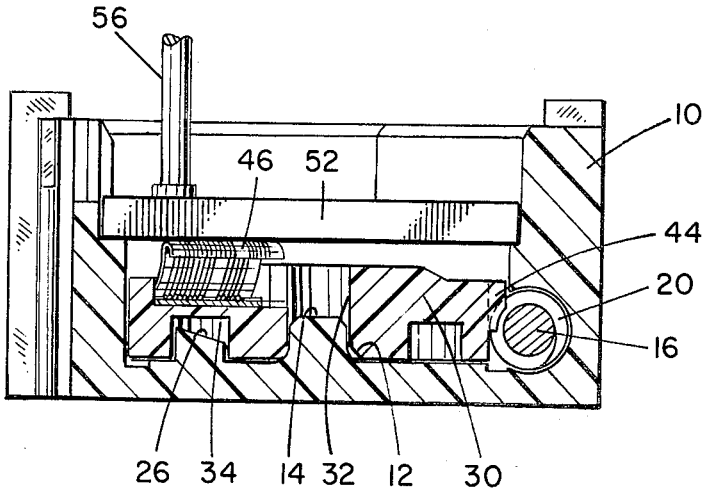
FIG. 7 is a cross-sectional view along line 7—7 of FIG. 6.

Thus, in FIGS. 6 and 7, the rotor 30 is shown just before it has reached its clockwise limit of travel. The rotor stop 36 is approaching, but has not yet reached, the flat (vertical) side 28 of the housing stop 24. The worm gear 20 is still in engagement with one or more spur gear teeth 40. As shown in FIG. 7, the rotor 30 is substantially level, flush against the bottom of the circular recess 12, with a clearance space between the rotor 30 and the substrate 52.

Figure 8:
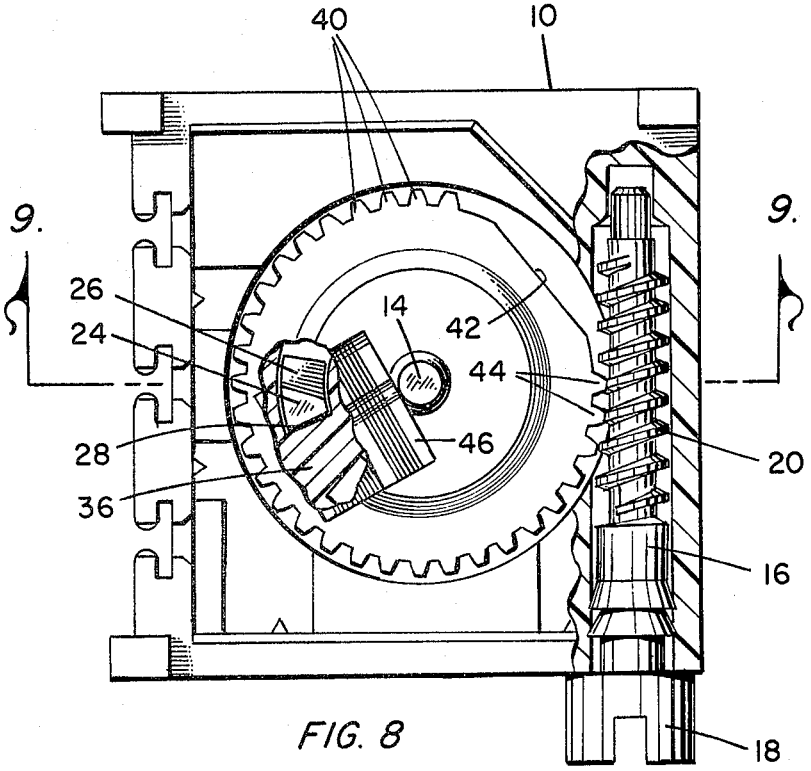
FIG. 8 is a view like that of FIG. 2 showing the rotor in its ratcheting position at its clockwise limit of travel.
Figure 9:
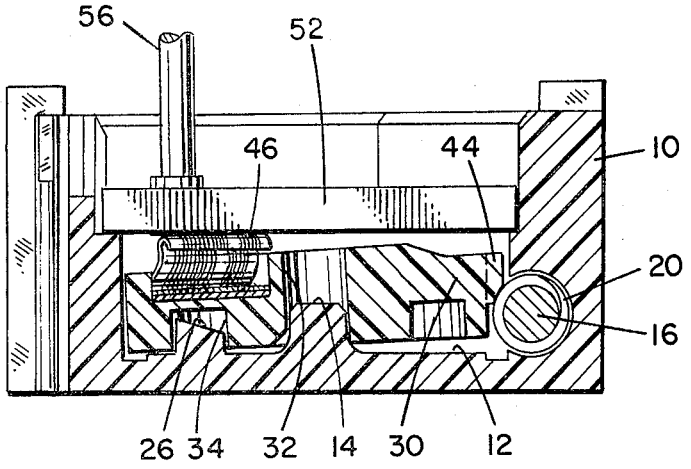
FIG. 9 is a cross-sectional view along line 9—9 of FIG. 8.

FIGS. 8 and 9 illustrate the ratcheting action that is results when the rotor 30 has reached its clockwise limit of travel. Further rotation of the rotor 30 is prevented by the abutment of the rotor stop 36 against the vertical wall 28 of the housing stop 24. With the rotor thus positioned, the shortened spur gear teeth 44 are in engagement with the worm gear 20. Further clockwise rotation of the screw 16 causes the shortened teeth 44 to lift up over the worm gear 20, thereby pivoting the rotor 30 upwardly from the edge remote from the worm gear, as shown in FIG. 9. This pivoting action compresses the wiper spring 46. As the screw 16 is further rotated in a clockwise direction, the worm gear 20 moves past the shortened teeth 44, and the force of the spring 46 snaps the rotor 30 downwardly to its original position. The shortened teeth 44 are now in position, relative to the worm gear 20, either to repeat the ratcheting action if clockwise rotation of the screw 16 is continued, or to engage the worm gear to rotate the rotor counterclockwise if the direction of screw rotation is reversed.

Because the ratcheting movement at the clockwise limit of rotor travel results in a type of "snapping" action of the rotor 30 against the housing, a relatively loud ratcheting sound or "click" is produced, even with relatively little compression of the spring 46. In some applications, it may thus be desired to use the "shortened tooth" arrangement at both limits of travel. However, this would necessitate shortened spur gear teeth on both sides of the gap 42 on the rotor edge. One set of such shortened teeth would, as shown in FIGS. 1, 7 and 9, extend partway down from the top surface of rotor, while the other set would extend partway up from the bottom surface. With this arrangement, the rotor would pivot upwardly at one limit of travel (as in FIG. 9), while it would pivot downwardly at the other limit of travel. Such an arrangement would require a clearance space below the rotor, as well as above it. This would not only complicate the manufacture of the device, but it would also necessitate a larger housing, thereby working against the goals of economy of manufacture and minimization of size.

Thus, the preferred embodiment, as described above, provides a ratcheting mechanism which achieves all of the goals sought in the art: reliability, simplicity of construction and compactness of size. In addition, an easily audible ratcheting sound is obtained at both limits of rotor travel. All of these goals are achieved in a device which, because of its simplicity, is economical to manufacture. Moreover, optimization of the ratchet mechanism design is not achieved at the expense of the electrical function of the potentiometer, in that design of the wiper spring 46 can be optimized for electrical function while still serving double duty in the ratcheting mechanism.

What is claimed is:

1. In a variable resistor, of the type having a housing, a rotor rotatable in said housing and bearing an electrical contact spring in contact with a resistive element, spur gear means on a peripheral edge of said rotor, and worm gear means in said housing for engagement with said spur gear means to drive said rotor between first and second limits of travel, a ratcheting mechanism, comprising:

first means for limiting the further rotation of said rotor substantially beyond said first and second limits of travel; and second means for pivoting said rotor against the force of said contact spring when said rotor has reached said first and second limits of travel, while allowing momentary disengagement of said spur gear means from said worm gear means;

whereby said contact spring is compressed by the pivoting of said rotor at said first and second limits of travel, and said spring is released by the disengagement of said spur gear means from said worm gear means, thereby to urge said rotor into a position in which said spur gear means re-engages said worm gear means.

2. The ratcheting mechanism of claim 1, wherein said first means comprises:

a first stopping element on one surface of said rotor; and a second stopping element in said housing against which said first stopping element is abuttable when said rotor is at said first and second limits of travel.

3. The ratcheting mechanism of claim 1, wherein said second means pivots said rotor in a direction which compresses said contact spring against said resistive element when said rotor is substantially at said first and second limits of travel.

4. The ratcheting mechanism of claim 2, wherein said second stopping element includes inclined surface means abuttable by said first stopping element when said rotor reaches at least one of said limits of travel, the abutment between said first stopping element and said inclined surface means causing a pivoting of said rotor against the force of said contact spring.

5. The ratcheting mechanism of claim 4, wherein said second means includes said inclined surface means.

6. The ratcheting mechanism of claim 4, wherein said second stopping means has first and second opposed, radially-extending sides, said first side having an inclined surface abuttable by said first stopping means when said rotor reaches said first limit of travel, and said second side having a substantially flat, vertical surface abuttable by said first stopping means when said rotor reaches said second limit of travel.

7. The ratcheting mechanism of claim 1, wherein said second means comprises:

lifting means on said rotor, and operable with said worm gear means when said rotor reaches at least one of said limits of travel, for pivotally lifting said rotor over said worm gear means, thereby to (a) pivot said rotor against the force of said contact spring, and (b) momentarily disengage said spur gear means from said worm gear means.

8. The ratcheting mechanism of claim 7, wherein said worm gear means includes a substantially continuous thread, and wherein said lifting means comprises:

an axially-shortened spur gear tooth extending only partway across said peripheral edge of said rotor, said tooth being so located on said rotor as to be engageable with said thread when said rotor has reached at least one of said limits of travel.

9. The ratcheting mechanism of claim 6, wherein said second means comprises:

first pivoting means for pivoting said rotor when said rotor has reached said first limit of travel; and second pivoting means for pivoting said rotor when said rotor has reached said second limit of travel.

10. The ratcheting mechanism of claim 9, wherein said first pivoting means comprises said first stopping means and said inclined surface, and wherein said second pivoting means comprises lifting means on said rotor, and operable with said worm gear means when said rotor reaches said second limit of travel, for pivotally lifting said rotor over said worm gear means, thereby to (a) pivot said rotor against the force of said contact spring, and (b) momentarily disengage said spur gear means from said worm gear means.

11. The ratcheting mechanism of claim 10, wherein said worm gear means includes a substantially continuous thread and wherein said lifting means comprises:

an axially-shortened spur gear tooth extending only partway across said peripheral edge, said tooth being so located on said rotor as to be engageable with said thread when said rotor has reached said second limit of travel.

12. In a variable resistor, of the type having a housing, a rotor rotatable in said housing and bearing an electrical contact spring in contact with a resistive element, spur gear means on a peripheral edge of said rotor, and worm gear means in said housing for engagement with said spur gear means to drive said rotor between first and second limits of travel, a ratcheting mechanism comprising:

first means for (a) limiting the further rotation of said rotor substantially beyond said first limit of travel, and (b) pivotally lifting said rotor against the force of said contact spring, while (c) allowing a momentary disengagement of said spur gear means from said worm gear means;

second means for substantially stopping said rotor from further rotation beyond said second limit of travel; and third means, operable with said worm gear means when said rotor reaches said second limit of travel, for (a) pivotally lifting said rotor over said worm gear means against the force of said contact spring, while (b) allowing a momentary disengagement of said spur gear means from said worm gear means;

whereby said contact spring is compressed by the pivoting of said rotor at said first and second limits of travel, and said spring is released by the disengagement of said spur gear means from said worm gear means, thereby to urge said rotor into a position in which said spur gear means re-engages said worm gear means.

13. The ratcheting mechanism of claim 12, wherein said rotor has first and second opposed surfaces, said first surface bearing said contact spring, and said second surface being adjacent an interior surface of said housing, and wherein said first means comprises:

a first stopping member on said second surface; and a second stopping member located on said interior surface of said housing and having a radially-extending surface abuttable by said first stopping member when said rotor has reached said first limit of travel, said radially-extending surface including ramp means for pivotally lifting said rotor while allowing said momentary disengagement of said spur gear means from said worm gear means.

14. The ratcheting mechanism of claim 13, wherein said radially-extending surface is a first radially-extending surface, and said second means comprises:

said first stopping member; and a second radially-extending surface on said second stopping member, said second radially-extending surface being abuttable by said first stopping member when said rotor has reached said second limit of travel.

15. The ratcheting mechanism of claim 12, wherein said rotor has first and second opposed surfaces joined by said peripheral edge bearing said spur gear means, and wherein said third means comprises:

an axially-shortened spur gear tooth extending only partway across said peripheral edge and located on said rotor so as to be engageable with said worm gear means when said rotor has reached said second limit of travel.

16. The ratcheting mechanism of claim 15, wherein said spur gear means comprises a plurality of evenly-spaced, radially-extending spur gear teeth extending substantially the entire width of said peripheral edge, and said axially-shortened tooth is adjacent a space on said peripheral edge which is substantially free of said spur gear teeth.

17. The ratcheting mechanism of claim 15, wherein said first surface of said rotor carries said contact spring and said second surface of said rotor is adjacent to an interior surface of said housing, and wherein said axially-shortened tooth extends only partway across said peripheral edge from said first surface.

18. The ratcheting mechanism of claim 17, wherein said first means comprises:

a first stopping member on said second surface; and a second stopping member located on said interior surface of said housing and having a radially-extending surface abuttable by said first stopping member when said rotor has reached said first limit of travel, said radially extending surface including ramp means for pivotally lifting said rotor while allowing said momentary disengagement of said spur gear means from said worm gear means.

19. The ratcheting mechanism of claim 18, wherein said radially-extending surface is a first radially-extending surface, and said second means comprises:

said first stopping member; and a second radially-extending surface on said second stopping member, said second radially-extending surface being abuttable by said first stopping member when said rotor has reached said second limit of travel.

20. In a variable resistor, of the type having a housing, a rotor rotatable in said housing, an electrical contact spring carried on a first side of said rotor so as to be in contact with a resistive element, spur gear means around less than the entire peripheral edge of said rotor, and worm gear means in said housing for engagement with said spur gear means to drive said rotor between first and second limits of travel, a ratcheting mechanism comprising:

a first stopping element on a second side of said rotor opposed to said first side and joined therewith by said peripheral edge, said second side of said rotor being adjacent an interior surface of said housing;

a second stopping element on said interior surface of said housing and having first and second radially-extending surfaces, said first radially-extending surface having an inclined area abuttable by said first stopping means when said rotor reaches said first limit of travel, thereby to pivotally lift said rotor, and said second radially-extending surface being abuttable by said first stopping means when said rotor has reached said second limit of travel, said second radially-extending surface being configured to prevent said rotor from rotation substantially beyond said second limit of travel; and an axially-shortened spur gear tooth extending only partway across said peripheral edge of said rotor from said first surface thereof, and located on said rotor so as to be engageable with said worm gear means when said rotor has reached said second limit of travel, thereby to pivotally lift said rotor.

* * * * *